United States Patent [19]

Dufour et al.

[11] 3,945,266

[45] Mar. 23, 1976

[54] CIRCUMFERENTIAL REGISTER ASSEMBLY

[75] Inventors: Charles H. Dufour, Westerly, R.I.; Robert D. Hercock, Fort Worth, Tex.

[73] Assignee: Harris Corporation, Cleveland, Ohio

[22] Filed: Nov. 6, 1974

[21] Appl. No.: 521,283

[52] U.S. Cl. ..... 74/401; 101/248

[51] Int. Cl.[2] ..... F16H 35/08; B41F 13/24

[58] Field of Search ..... 74/403, 402, 401, 400; 101/248

[56] References Cited

UNITED STATES PATENTS

| | | | |
|---|---|---|---|
| 2,181,894 | 12/1939 | Huck | 74/401 X |
| 2,660,115 | 11/1953 | Ras | 101/248 |
| 2,749,984 | 6/1956 | Hallden | 74/401 X |
| 3,044,319 | 7/1962 | Worlidge | 74/403 X |

*Primary Examiner*—Leonard H. Gerin

[57] ABSTRACT

A mechanism for adjusting the circumferential position of a printing cylinder includes first and second meshing helical gears. The helical gears are supported coaxially of the printing cylinder. A first one of the helical gears is fixed to the printing cylinder to rotate with the cylinder. The other of the helical gears is supported for movement axially relative to the first helical gear to effect a camming action therebetween which rotates the first helical gear and thus rotates the cylinder. However, upon axial adjustment of the cylinder, both of the helical gears move simultaneously axially with the cylinder.

9 Claims, 3 Drawing Figures

CIRCUMFERENTIAL REGISTER ASSEMBLY

BACKGROUND OF THE PRESENT INVENTION

The present invention relates to a mechanism for adjusting the circumferential position of a printing cylinder.

There are many known mechanisms for adjusting the circumferential position of a printing cylinder. Typically, such circumferential adjustment mechanisms include a sliding helical gear which meshes with another helical gear, and upon relative axial sliding movement between the gears, the printing cylinder is rotated for purposes of circumferential register adjustment of the cylinder. Many such designs are somewhat complicated due to the fact that when the cylinder is moved axially for side adjustment of the cylinder, one of the helical gears moves relative to the other helical gear, and thus axial adjustment of the cylinder could destroy the circumferential register of the cylinder, unless compensation is provided. Many efforts have been made in order to compensate for the undesired circumferential change in cylinder adjustment which occurs upon such axial movement of the cylinder. Frequently, compound gearing has been utilized to compensate for the circumferential change upon axial movement of the cylinder, and U.S. Pat. No. 3,717,092 discloses a known manner of solving the problem to which the present invention is directed.

U.S. Pat. No. 3,630,145 discloses another approach to the solution of the above noted problem, however, the complexity and non-coaxial arrangement of the gearing is a substantial disadvantage to such a design.

SUMMARY OF THE PRESENT INVENTION

The present invention eliminates the above-noted problem by providing for axial movement of both of the helical gears (which effect circumferential adjustment) upon movement of the printing cylinder axially. Since both of the helical gears move axially simultaneously on axial adjustment of the printing cylinder, there is no relative axial movement between the helical gears and thus no circumferential shift of the cylinder upon axial adjustment of the cylinder. This eliminates the need for any compensation structure. The structure of the present invention is such that for purposes of circumferential adjustment, one of the helical gears is moved axially relative to the other of the helical gears. The one helical gear which is moved axially may be moved by a hand-actuated mechanism or, preferably, may be powered axially by a suitable motor. The drive connection between such a motor and the helical gear for moving the helical gear axially includes a slip connection so that the helical gear can move axially on axial adjustment of the cylinder, and the motor which drives the helical gear does not. However, the motor may also move axially with the cylinder, eliminating the need for such slip connection.

DESCRIPTION OF THE DRAWINGS

Further features and advantages of the present invention will be apparent to those skilled in the art to which it relates from the following detailed description of a preferred embodiment thereof made with reference to the accompanying drawings wherein.

DESCRIPTION OF A PREFERRED EMBODIMENT

Figure 1:
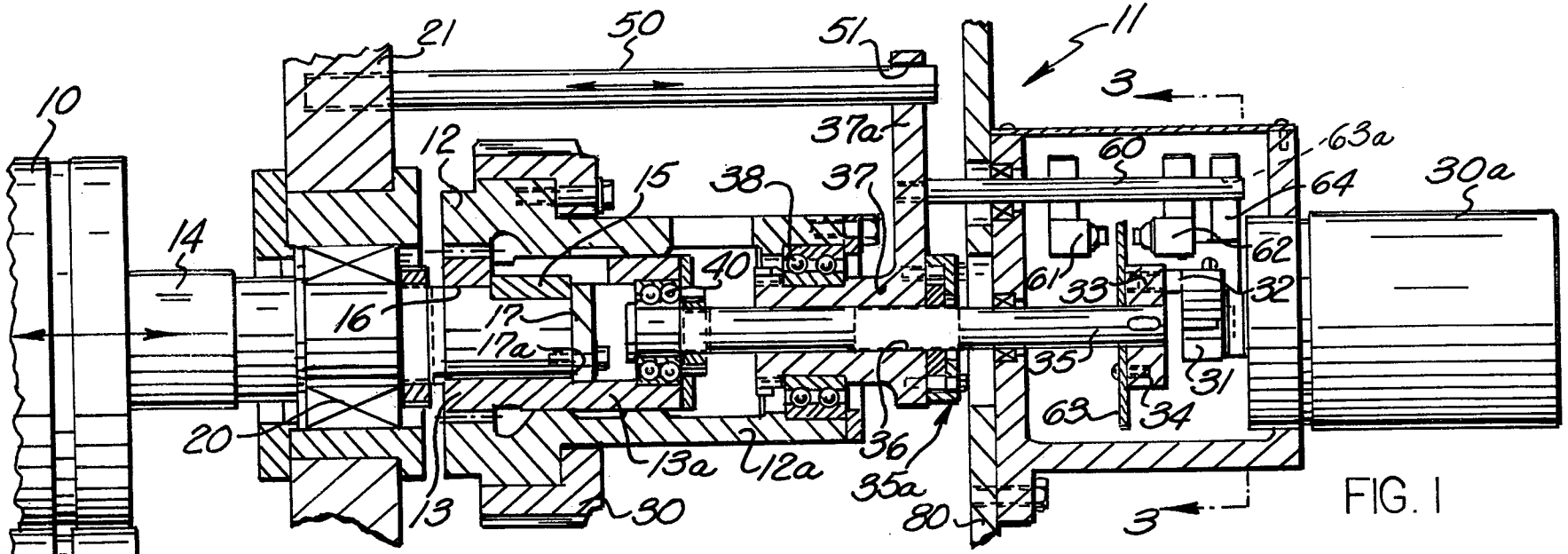
FIG. 1 is a sectional view of the mechanism for adjusting a printing cylinder circumferentially.
Figure 3:
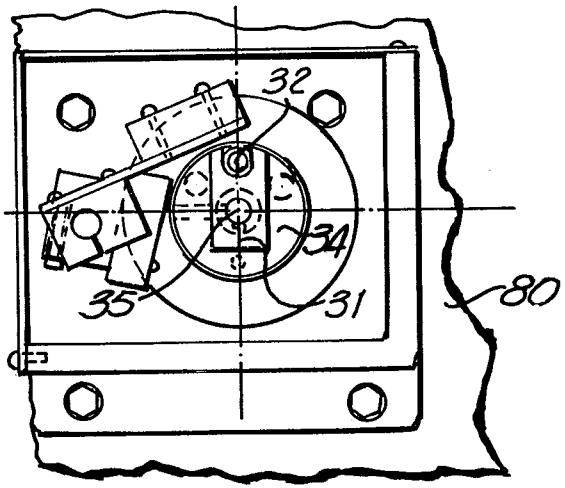
FIG. 3 is a view taken approximately along the line 3—3 of FIG. 1.

As noted hereinabove, the present invention is directed to a mechanism for circumferentially adjusting a printing cylinder, and the invention is illustrated in the drawings as embodied in a mechanism for adjusting a printing cylinder 10. The desirability of adjustment of printing cylinders is well known, and the reasons for such adjustment will not be set forth herein, since they are well known.

Figure 2:
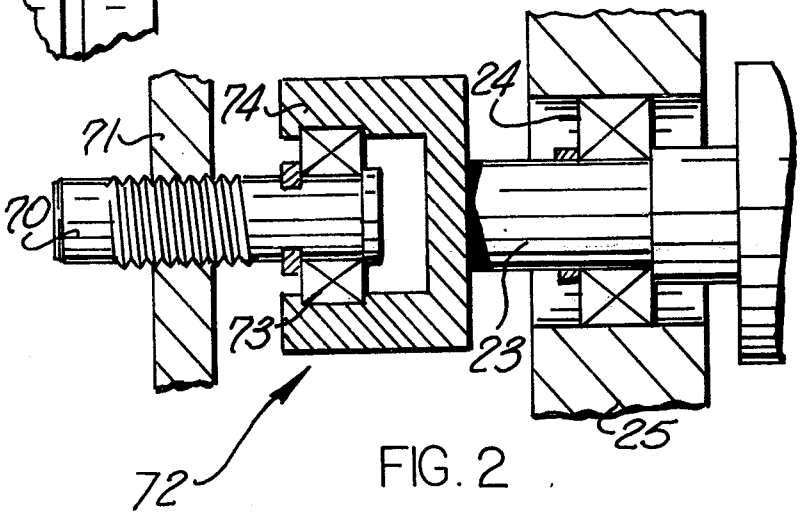
FIG. 2 is a schematic view illustrating the mechanism for adjusting the printing cylinder of FIG. 1 axially.

The printing cylinder 10 is adjusted circumferentially by a mechanism generally designated 11 in FIG. 1. cylinder cylinder 10 is also adjustable axially by a mechanism generally designated 72 in FIG. 2. The circumferential adjustment mechanism 11 is located on the right side of the cylinder, as illustrated in the drawings, whereas the mechanism 72 for adjusting the cylinder axially is located on the left side of the cylinder 10, as viewed in the drawings.

The circumferential adjustment mechanism 11 includes a pair of helical gears 12, 13. The helical gears 12, 13 are mounted coaxially of the cylinder 10 i.e. they rotate about as axis common with the axis of the cylinder 10.

The helical gear 13 is fixedly mounted on the spindle 14 of the cylinder 10 so as to rotate with the cylinder 10 and also to move axially with the cylinder 10. The gear 13 has helical gear teeth mounted on the left end thereof which mesh with helical gear teeth on the gear 12, and in addition, the gear 13 has a projecting sleeve portion 13*a* which is keyed by a suitable key 15 for rotation with the spindle 14. In addition, the gear 13 is fixed against axial movement on the spindle 14 between a shoulder 16 on the spindle and a cap 17 suitably secured to the end of the spindle 14 and which also engages an internal shoulder 17*a* on the gear sleeve portion 13*a*. A slight gap can exist between cap 17 and the end of spindle 14 in order that the gear 13 be securely held in position.

The spindle 14 of the cylinder is supported in a suitable bearing 20 in a housing member 22. The left side of the cylinder 10 also has a spindle projecting therefrom, designed 23, (FIG. 2). The spindle 23 is supported in a bearing 24 mounted in a frame member 25. The bearings 20 and 24 are supported in the housing and frame mmbers 22, 25 for sliding movement therein for purposes of axial adjustment of the cylinder, and, of course, the bearings support the cylinder 10 for rotation relative to the members 22 and 25.

The cylinder 10, of course, is driven for purposes of printing through a main drive gear 30 which is suitably secured to the gear member 12. The drive to the cylinder during printing is through the gear 30, the meshing helical teeth of the gears 12, 13, through the key 15, to the spindle 14. The outer peripheral gear teeth on the gear 30 are spur gear teeth, that is, the gear teeth extend parallel to the axis of rotation of the gear.

Circumferential adjustment of the cylinder 10 occurs upon relative axial movement of the gears 12, 13. Upon this relative axial movement, the meshing helical gear teeth of the gears 12, 13, cause a camming action to occur which results in circumferential movement of the cylinder 10. In the embodiment illustrated in FIG. 1, the gear 12 is moved axially relative to the gear 13 to effect this camming action. When this axial movement of the gear 12 occurs, the gear 30 likewise is moved axially, but since the teeth thereon are spur gear teeth, the gear 30 is free to move axially relative to its meshing gear, not shown. Also, due to the meshing engagement of the teeth of the gear 30 with its meshing gear and the resistance which this creates to rotation of the gear 12, on axial movement of the gear 12, the gear 13 will be cammed and rotate, rather than the gear 12.

The gear 12 is moved axially for purposes of circumferential adjustment of the cylinder 10 by energization of a motor 30*a*. The motor 30*a* has an output 31 which includes a pin 32 which is located offset from the axis of the cylinder 10, but is rotated about an axis coextensive with the cylinder axis upon energization of the motor 30*a*. The pin 32 is screwed into an opening 33 in a coupling member 34, which coupling member 34 is drivingly connected to a drive shaft or rod 35. The pin 32 is slidably received in an opening in member 31. The rod on shaft 35 is threadedly engaged at 36 in a threaded bore in a bracket member 37. The bracket member 37, in turn, has a bearing 38 interposed between the outer periphery of the bracket member 37 and a projecting sleeve portion 12*a* of the helical gear 12. The bearing 38 is trapped against axial movement relative to the bracket 37, as well as trapped against axial movement relative to the sleeve portion 12*a* of the gear 12. This trapping is effected by means of suitable shoulders, a cap and a retaining ring, as shown in FIG. 1.

The leftwardmost end of the rod 35 is supported by a bearing 40 which is located intermediate the sleeve portion 13*a* of the helical gear 13 and the outer end of the rod 35. Again, the bearing 40 is suitably supported so as not to move axially relative to either the rod 30 or the sleeve portion 13*a* of the gear 13. A suitable antibacklash mechanism 35*a*is associated with the shaft 35.

Accordingly, upon energization of the motor 30, the shaft 35 is rotated through the pin 32. When the shaft 35 is rotated, it cannot move axially due to the fact that the shaft 35 is fixed at its left end, in effect, to the cylinder 10 which holds it from axial movement. However, due to the threaded engagement between the shaft 35 and the bracket member 37, the bracket member 37 will be moved axially relative to the shaft 35. The bracket member 37, when it is moved axially, forces the gear 12, axially relative to the gear 13, and as the gear 12 moves axially relative to the gear 13, the afore-mentioned camming action between the gear teeth of the gears 12 and 13 occurs and the cylinder 10 is moved circumferentially.

A rod 50 is provided which extends through an opening 51 in the bracket member 37, and the rod 50 guides the axial movement of these parts and prevents rotation of bracket 37 about shaft 35. Also, a rod 60 is threaded at one end into a projecting portion 37*a* of the bracket 37 and the rod 60 extends toward the motor 30*a*. The rod 60 carries a pair of switches 61, 62. These switches are interposed on opposite sides of a plate 63. The switches 61, 62, of course, move axially on circumferential adjustment of the cylinder 10 due to the fact that they are carried by the rod 60. The switches 61, 62 are merely limit switches which limit the amount of circumferential adjustment of the cylinder that can occur. These switches 61, 62, when tripped by engagement with the plate 63, will de-energize the motor 30, thus limiting the amount of circumferential adjustment which can occur. A third switch 64 is required to be mounted on rod 60 when closed loop digital register is desired. This third switch 64 alerts the electronic register controls as to the direction of adjustment from zero, whether it be advance or retard.

The axial adjustment mechanism 72 for adjusting the cylinder 10 axially is shown schematically in FIG. 2 and merely comprises a shaft 70 which, when rotated relative to a member 71, moves axially relative to the member 71. The shaft 70 is associated with the spindle 23. Specifically, the shaft 70 has a bearing 73 interposed between the end of the shaft 70 and a block member 74. The bearing 73 is trapped in the block member 74 on the rod 70 so as to not move axially relative to either. Accordingly, upon axial movement of the shaft 70, the axial force is transmitted through the bearing 73 to the block member 74. The block member 74 is secured to the spindle 23 so as to cause the spindle 23 to move axially as well. This results in the bearings 24 and 20 for the cylinder 10 sliding in the frame and housing members 25, 22, respectively, and thus axial movement of the cylinder 10 results.

In addition, the circumferential adjusting mechanism, namely, the gears 12, 13, are moved axially bodily as a unit upon axial adjustment of the cylinder 10. Therefore, there is no relative axial movement between the gears 12, 13 upon axial adjustment of the cylinder 10. Accordingly, the afore-mentioned problem which has plagued the prior art is avoided in the present structure, and no compensating structure as mentioned above is required.

It should be clear that not only are the gears 12, 13 moved axially upon axial adjustment of the cylinder 10, but also the rod, 35, the bracket 37, and the rod 60, as well as the plate 63 are moved axially. Of course, since the rod 60 which carries the switches 61, 62 and the plate 63 all move axially, the relative position between the plate 63 and the switches 61, 62 does not change.

The motor 30, however, on axial adjustment of the cylinder 10 does not necessarily have to move axially. The motor 30 is securely bolted to a motor housing which, in turn, is mounted to a gear shield member 80, and it does not move axially. There is a slip connection between the pin 32 and the member 31, and due to the fact that there is relative axial slipping motion between the pin 32 and the member 31, the axial adjustment of the cylinder 10 can occur without axial movement of the motor 30.

Thus, it should be clear that the present invention provides a rather compact circumferential adjustment mechanism where the helical gears 12, 13 which effect the circumferential adjustment on relative axial movement therebetween are located coaxially with the cylinder 10.

In addition to being located coaxially relative to the cylinder 10, these gears are bodily adjusted as a unit upon axial adjustment of the cylinder 10 so that the circumferential adjustment of the cylinder 10 is not detrimentally affected by axial adjustment of the cylinder 10.

Having thus described the invention we claim:

1. Apparatus comprising a printing cylinder, a first member and a second member, means supporting said first and second members coaxially of the printing cylinder, means fixing a first one of said members to said cylinder to rotate said cylinder and to move axially with said cylinder, means for moving said second member axially relative to said first member, said first and second members having cooperating engaging parts which effect a camming action therebetween upon relative axial movement and rotation of said member and said cylinder, and means for moving said cylinder and both of said members simultaneously axially.

2. Apparatus as defined in claim 1 wherein said means for moving said second member axially relative to the first member to effect said camming action therebetween comprises a motor, a drive shaft drivingly rotated by said motor, a bracket member, cooperating engaged threads between said drive shaft and bracket member, means for resisting axial movement of the drive shaft, and means interconnecting said bracket member and said second member to effect axial movement of said second member upon axial movement of said bracket member.

3. Apparatus as defined in claim 1 wherein said first and second members comprise helical gears.

4. Apparatus comprising a printing cylinder, first and second meshing helical gears, means supporting said first and second helical gears coaxially of the printing cylinder, means fixing a first one of said gears to said cylinder to rotate said cylinder and to move axially with said cylinder, means for moving said second helical gear axially relative to said first helical gear to effect a camming action therebetween and rotation of said first gear and said cylinder, and means for moving said cylinder and both of said gears simultaneously axially, said means for moving said second helical gear axially relative to the first helical gear to effect said camming action therebetween comprising a motor, a drive shaft drivingly rotated by said motor, a bracket member, cooperating engaged threads between said drive shaft and bracket member, means for resisting axial movement of the drive shaft, means for guiding axial movement of said bracket member, and means interconnecting said bracket member and said second helical gear to effect axial movement of said second helical gear upon axial movement of said bracket member.

5. Apparatus comprising a printing cylinder, first and second meshing helical gears, means supporting said first and second helical gears coaxially of the printing cylinder, means fixing a first one of said gears to said cylinder to rotate said cylinder and to move axially with said cylinder, means for moving said second helical gear axially relative to said first helical gear to effect a camming action therebetween and rotation of said first gear and said cylinder, and means for moving said cylinder and both of said gears simultaneously axially, and further including a motor and a drive means interconnecting said motor and said second helical gear to effect axial movement of said helical gear upon energization of said motor, said drive means including a slip connection therein enabling axial movement of a portion of said drive means and said second helical gear relative to said motor upon axial movement of said cylinder.

6. Apparatus as defined in claim 5 further including means for securing said motor against axial movement.

7. Apparatus as defined in claim 5 including limit means for limiting the amount of axial movement of said second helical gear, said limit means terminating operation of said motor, means supporting said limit means for axial movement with said second helical gear and a member carried by said shaft and engageable with said limit means to actuate said limit means upon engagement therewith.

8. Apparatus comprising a printing cylinder, first and second meshing helical gears, means supporting said first and second helical gears coaxially of the printing cylinder, means fixing a first one of said gears to said cylinder to rotate said cylinder and to move axially with said cylinder, means for moving said second helical gear axially relative to said first helical gear to effect a camming action therebetween and rotation of said first gear and said cylinder, and means for moving said cylinder and both of said gears simultaneously axially, and wherein said means for moving said second helical gear axially comprises an electric motor and a drive means interposed between said motor and said second helical gear.

9. Apparatus as defined in claim 8 further including limit switches for deenergizing said motor to limit the amount of axial movement of said second helical gear relative to said first helical gear and thereby limiting the amount of circumferential adjustment of said cylinder.

* * * * *